US010234135B2

(12) United States Patent
Major

(10) Patent No.: US 10,234,135 B2
(45) **Date of Patent: *Mar. 19, 2019**

(54) DEVICE AND METHOD FOR PRODUCING FUEL EFFICIENT CANDLES CONFIGURED WITH HELICAL WICKS

(71) Applicant: Paul Cameron Major, San Jose, CA (US)

(72) Inventor: Paul Cameron Major, San Jose, CA (US)

( * ) Notice: Subject to any disclaimer, the term of this patent is extended or adjusted under 35 U.S.C. 154(b) by 285 days.

This patent is subject to a terminal disclaimer.

(21) Appl. No.: 15/402,196

(22) Filed: Jan. 9, 2017

(65) Prior Publication Data

US 2017/0114997 A1 Apr. 27, 2017

Related U.S. Application Data

(63) Continuation-in-part of application No. 15/383,542, filed on Dec. 19, 2016.

(51) Int. Cl.
*F23D 3/16* (2006.01)
*C11C 5/02* (2006.01)

(52) U.S. Cl.
CPC ..... *F23D 3/16* (2013.01); *C11C 5/023* (2013.01)

(58) Field of Classification Search
CPC ..... C11C 5/008; C11C 5/006; F21V 35/00
USPC ..... 431/125, 288–297, 324, 325
See application file for complete search history.

(56) References Cited

U.S. PATENT DOCUMENTS

2011/0256492 A1* 10/2011 Navarro ..... B65D 1/22 431/289
2016/0319220 A1* 11/2016 Ward ..... C11C 5/008

* cited by examiner

*Primary Examiner* — Vivek K Shirsat
(74) *Attorney, Agent, or Firm* — Stephen E. Zweig

(57) ABSTRACT

Helical wick candle and method of manufacturing this candle. The candle typically comprises a candle with meltable fuel such as wax, and at least one helical wick with a helical radius of at least ¼" or greater. This helical wick is configured so that as the candle burns, the burning tip of the wick doesn't remain stationary, but rather circles the axis of the wick so as to burn more of the wax than would otherwise be possible with a prior art straight wick candle, at least when the diameter of the candle is larger than the pool of melted wax surrounding the wick. This results in higher fuel burning efficiency, often 1.5× or higher, as well as various interesting artistic shapes as the wick burns. Various wick sheath methods to improve the rigidity and burn resistance of the wick during the burning process are also discussed.

21 Claims, 5 Drawing Sheets

DEVICE AND METHOD FOR PRODUCING FUEL EFFICIENT CANDLES CONFIGURED WITH HELICAL WICKS

CROSS REFERENCE TO RELATED APPLICATIONS

This invention is a continuation in part of U.S. patent application Ser. No. 15/383,542 "DEVICE AND METHOD FOR PRODUCING FUEL EFFICIENT CANDLES CONFIGURED WITH HELICAL WICKS", inventor Paul Cameron Major, filed Dec. 19, 2016, the entire contents of which are incorporated herein by reference.

BACKGROUND OF THE INVENTION

Field of the Invention

This invention is in the field of candles and candle making.

Description of the Related Art

Candles, often defined as a cylinder or block of wax, tallow, or other solid hydrocarbons type fuel material, and having an embedded wick that is burned to give light, are of ancient origin and date back thousands of years.

Modern candle wicks are often formed from braded cotton, and work by conducting the melted hydrocarbons to the flame. Candle wicks further comprise various stiffeners, such as thin wire, synthetic fibers, and the like, that make the wick more rigid. Candle wicks can also be treated with various flame resistant chemicals such as salt and borax to improve rigidity and reduce the rate at which the wick is consumed. Other materials used in candle wicks can include wood, other common string materials, often composed of cellulose and the like.

Although candle wicks are typically straight, other types of wick configuration are known in the art. For example, Decker, U.S. Pat. No. 9,410,696 teaches a planar wick configuration.

Wilson, in U.S. Pat. No. 3,121,316 teaches a non-combustible wick with a helical wick and a helical wick holder forming concentrically increasing spirals. This holder generally rests on top of the candle wax, and the wick does not extend into the candle wax.

Mineath, U.S. Pat. No. 1,608,518 teaches a candle with a cotton wick, which is impregnated with a chlorate salt solution. This wick is configured in a helical configuration for purposes of giving a colored flame.

Spiral Light Candle, produced by Spiral Light Candle, Hillsboro N. Dak., produces a dual-wick candle with a wick wound in a spiral just inside of the outer circumference of a round or rectangular candle, and a straight inner wick. The outer spiral wick is lit first, and as it winds around the outer circumference of the candle, the wax in the outer circumference is consumed. A puddle of melted wax gradually accumulates in the center of the candle, and eventually the outer helical wick either self-extinguishes or terminates. The user can then continue burning the remainder of the candle by lighting the straight inner wick.

BRIEF SUMMARY OF THE INVENTION

The invention is based, in part, on the insight that single wick candles with diameters of roughly an inch or more tend to burn inefficiently. Typically the burning wick only produces enough heat to melt the wax in close proximity to the wick, leaving much of the surrounding wax walls of the candle intact as the candle burns down. This inefficiency becomes more pronounced as the diameter of the candle increases.

It would thus be desirable to devise a device and method of producing an improved, larger diameter, single wick candle that is able to reliably consume a larger amount (e.g. 70-100%) of the candle wax or other solid fuel material.

The invention is also based, in part, on the insight that only a limited range of helix diameters and helix angles (e.g. the angle between the helix and a right angle with respect to the helix main axis), or helix pitches (where the pitch is the height of one complete helix turn), relative to the overall diameter of the candle body, and the properties of the wick and candle material, will be able to achieve these objectives.

The invention is also based, in part, on the insight that in some embodiments, it may further be desirable to convey additional structural support to the wick by surrounding the wick with a sheath of organic cellulose or cellulosic fibers. These cellulose or cellulosic fibers, although ultimately burning as the wick burns, can be selected so as to have a tendency to initially at least partially resist burning before completely burning.

In some embodiments, this sheath of organic cellulose or cellulosic fibers may be further selected as to have a substantial moisture content, such as 20, 40, 60, 80% water or more, such that the water, though vaporization as the candle wick burns, helps the wick resist burning. In some embodiments, this sheath may be formed from fresh (i.e. non-dried) plant material, such as leaves, onion skin, and the like.

This helps to prevent the wick from collapsing, and makes for a more attractive and easier to light candle.

DETAILED DESCRIPTION OF THE INVENTION

As previously discussed, in some embodiments, the invention may be a helical wick candle (e.g. candle apparatus), and method of manufacturing this candle. The candle typically comprises a candle formed from meltable fuel such as wax. Although the examples herein typically illustrate cylindrical candles, other shapes (e.g. solid rectangular shapes, pentagonal shapes, oblong shapes, irregular shapes, and the like) are also contemplated, and the cylindrical examples discussed herein are not intended to be limiting.

The candle will typically have at least one helical wick with a helical radius of at least ¼" or greater, often ½", 1" or greater. This helical wick (with or without the optional sheath, which will be discussed later) may have its own thickness, such as about 1/32" to about ¼" radius thickness, and is configured so that as the candle burns, the burning tip of the wick doesn't remain stationary, but rather circles the axis of the wick so as to burn more of the wax than would otherwise be possible in traditional straight wick designs.

In cases, such as when the diameter of the candle is larger than the pool of melted wax surrounding the wick, this helical wick configuration results in higher efficiency, as well as various interesting artistic shapes as the wick burns.

Various wick sheath methods to improve the rigidity burn resistance of the wick during the burning process will also be discussed.

Figure 1A:
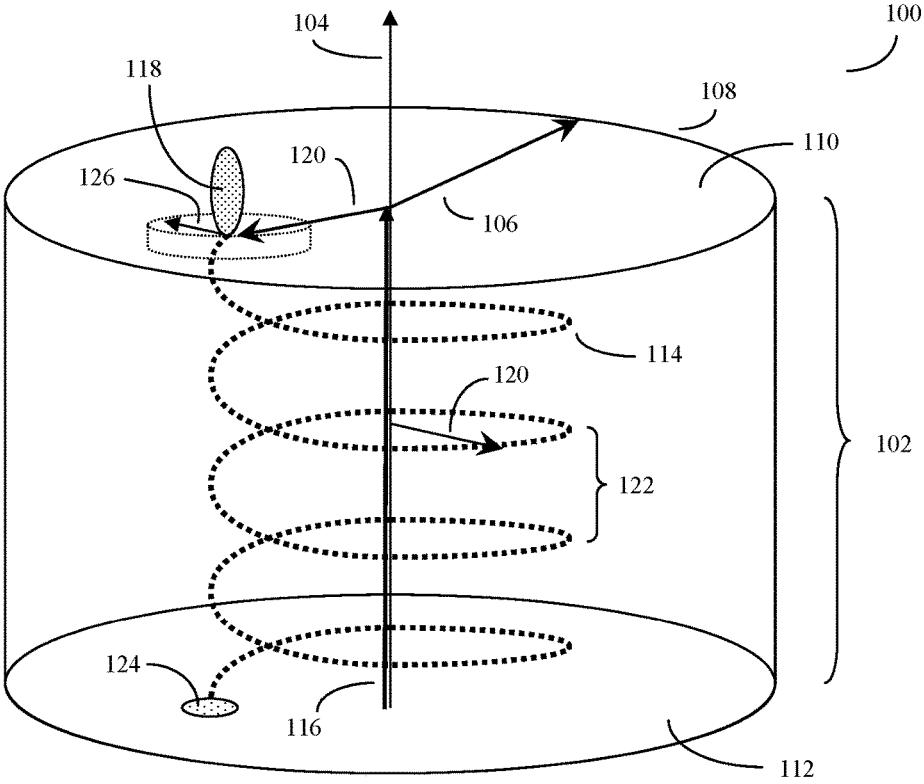
FIG. 1A shows an embodiment of the candle apparatus employing a single, larger diameter (about 1" radius), helical wick.

FIG. 1A shows an embodiment of the invention. In this embodiment, the invention may be a candle apparatus (100) with a candle height (102), candle axis (104), candle radius (106), and candle circumference (108), candle top (110) and candle bottom (112). Typically the candle will comprise a body of meltable fuel. (In FIG. 1A, assume that substantially the entire candle from top to bottom is formed from this meltable fuel).

Note that in embodiments where the candle is not cylindrical, generally the same nomenclature may be used. Here the axis of the candle can comprise an axis of rotation for ovals or regular solid shaped candles. Here n-sided solids, where n is 3 or greater, such as triangular shapes, square, pentagons, hexagons, and higher are contemplated. The radius of the candle can comprise the average distance from the axis of rotation to the sides of the candle. The candle circumference can comprise the perimeter of the candle surrounding the axis of rotation, and so on.

The candle will also comprise a helical wick (114) with a helical wick axis (116). Note that in FIG. 1A and the examples disclosed herein, the helical wick axis (116) is shown essentially coinciding with the candle axis (104), but in other embodiments, the helical wick axis (116) may be displaced from the candle axis (104) to achieve various artistic effects. Typically the helical wick axis (116) will be disposed at least proximate to the candle axis (104).

Note that in embodiments where the helical wick is not completely cylindrical, generally the same nomenclature may also be used. Here the helical wick can also be wound around a regular solid, oval, or the like. In addition to circular and oval shapes, n-sided solids, where n is 3 or greater, such as triangular shapes, square, pentagons, hexagons, and higher are contemplated.

The helical wick can also further comprise various stiffeners, such as thin wire, synthetic fibers, and the like, that make the helical wick more rigid. The helical wick can also be treated with various flame resistant chemicals such as salt and borax to improve rigidity and reduce the rate at which the wick is consumed.

This helical wick (114) will typically have a burnable tip (shown by the flame 118), a helical wick radius (120) that has a length that is less than the candle radius (106), a helical wick pitch (122), and a helical wick height (here assume that the helical wick axis 116 is also showing the helical wick height) that is at least as great as the candle height (102).

The helical wick radius (120) will typically be of significant size, such as ¼ inch (¼") or ½" or greater depending on the size of the candle and the artistic or technical effect desired. This helical wick (114) will typically extend from at least the candle top (110) to the candle bottom (112). Here the bottom termination of the helical wick (114), which in some embodiments may be anchored at the bottom by an anchoring device (e.g. a small metal disk or the like), is shown as (124). The helical wick will also make at least one full turn between the candle top (110) and candle bottom (112).

The helical wick (114) will typically be configured so that when the tip (118) burns in the body of meltable fuel, the meltable fuel melts within a melting radius (126) of said tip (118). Here, according to the invention, the sum of the helical wick radius (120) and the melting radius (126) will often be set to be less than the candle circumference (106). This will be done whenever it is desired to maintain at least some remaining wall of unmelted meltable fuel around the circumference of the candle.

However if this option is not desired (for example, the candle may be surrounded by a burn resistant support such as a glass or metal container), then the sum of the helical wick radius (120) and the melting radius (126) may be set to be greater than the candle circumference to, for example, help ensure that all fuel is consumed.

According to the invention, in a preferred and higher efficiency embodiment, the helical wick pitch (122) will be configured so that the tip (118), when the tip burns in the body of meltable fuel, rotates through one complete turn of the helical wick (114) during substantially the same amount of time that it takes for the helical wick (e.g. the burning tip of the helical wick 118) to burn the meltable fuel melted by the tip (118).

However other embodiments are possible. If the helical wick pitch (122) (e.g. the height of one complete helix turn) is set at a lower value (e.g. we have a more tightly wound helix that packs more wick material in the height of the candle), then more wick material is being used than is necessary for the candle to operate, but the candle will still function. If the helical wick pitch (122) is set at a higher value (e.g. we have a more loosely wound wick that packs less wick material in the height of the candle), the candle will have a tendency to burn fuel less efficiently, but again the candle will continue to operate.

Figure 1B:
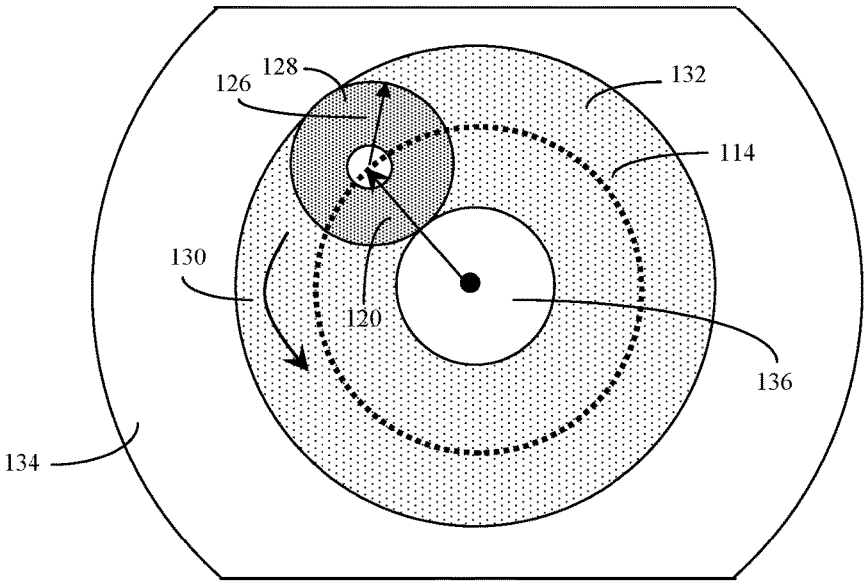
FIG. 1B shows a top view of the candle apparatus previously shown in FIG. 1A.

FIG. 1B shows an overhead view of the top of the candle previously shown in FIG. 1A, with some of the sides of the candle truncated in order to have the image fit in the available space. As the tip of the wick (118) burns, burnable fuel within melting radius (126) is consumed in a roughly circular pattern (128), here called a proximate wick melting zone. Due to the helical nature of the wick, as the tip (118) burns, the proximate wick melting zone (128) moves (130) around the wick axis (116), gradually consuming the meltable fuel in a circular burning pattern (132). The remaining hollow wall of unmelted meltable fuel is shown as (134)

Note that depending on the wick radius (120) and the melting radius (126) chosen, in some embodiments, as desired, there may be a central rod of unmelted fuel remaining (136). Although less favored because this is less fuel efficient, this embodiment can be chosen as desired.

Figure 2A:
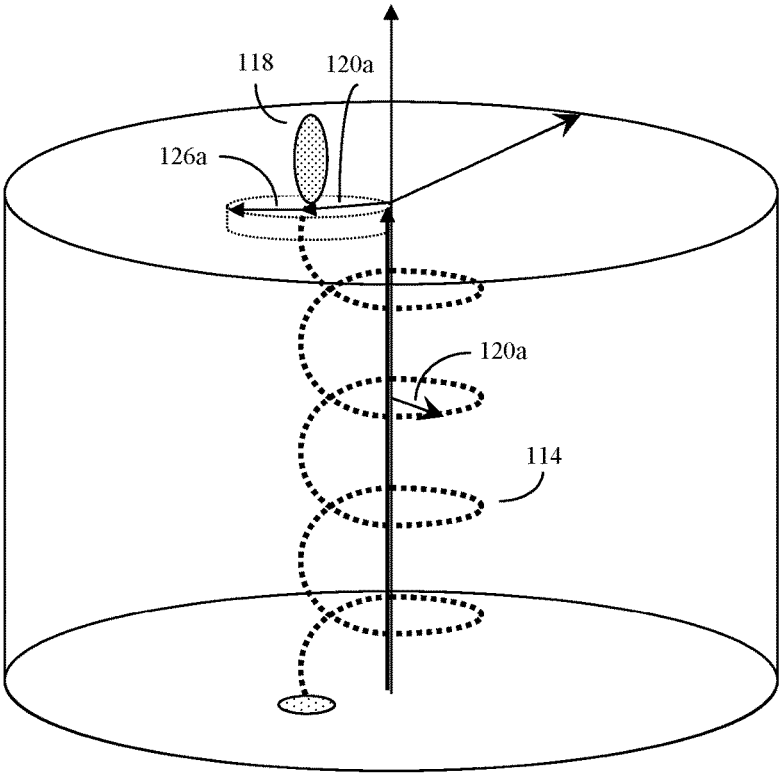
FIG. 2A shows an embodiment of the candle apparatus employing a single, smaller diameter, (about ½" radius) helical wick.

FIG. 2A shows a more fuel efficient embodiment of the invention. Here the helical wick radius (120*a*) and melting radius (126*a*) are set so that there is no central rod of unmelted fuel (136) remaining.

FIG. 2B shows an overhead view of the top of the candle previously shown in FIG. 2B, again with some of the sides of the candle truncated in order to have the image fit in the available space. As before, as the tip of the wick (118) burns, burnable fuel within melting radius (126*a*) is consumed in the proximate wick melting zone (e.g. roughly circular pattern (128*a*). Here as well, due to the helical nature of the wick, as the tip (118) burns, the proximate wick melting zone (128*a*) moves (130*a*) around the wick axis (116), gradually consuming all of the meltable fuel within the circular burning pattern (132*a*).

Figure 2B:
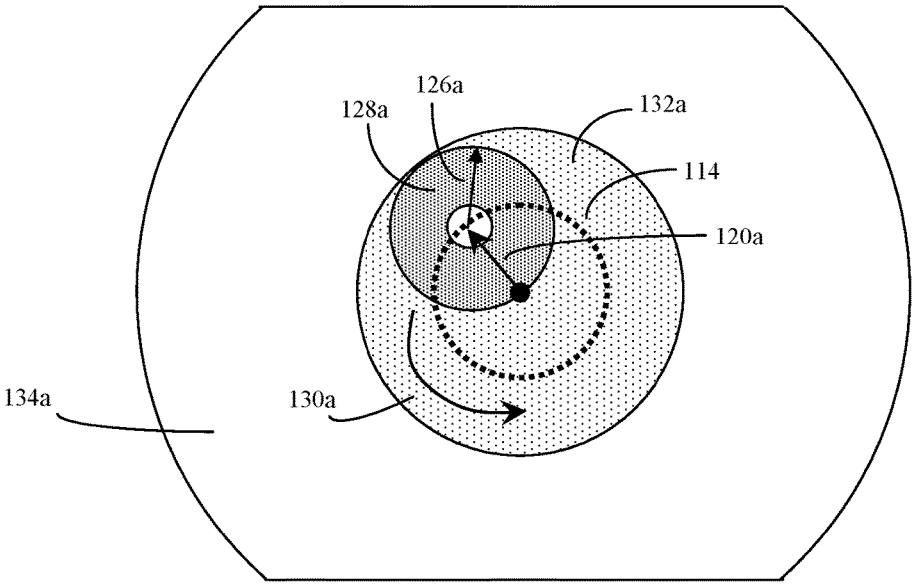
FIG. 2B shows an embodiment of the candle apparatus previously shown in FIG. 2A.

As can be seen in the FIG. 2B example, assuming that the proximate wick melting zone (128*a*) has a radius of ½", and the wick radius is also ½", and the radius of the candle is substantially greater than 1", then the area of the proximate wick melting zone is $\pi r^2$ or $\pi(½)^2$ about 0.785 square inches, while the area of the circular burning pattern (132*a*) is about $\pi(½+½)^2$ or roughly 3.14. So in this example, under this set of conditions, the helical wick configuration results in a 4 times (400%) higher efficiency of fuel consumption.

Other configurations may result in a greater or lesser increase in efficiency of fuel consumption. In some embodiments, according to the invention, various helical wick radius and pitch configurations can be selected as to improve the efficiency of fuel consumption to be at least 1.5× higher, and often 2× or more higher than that of corresponding standard straight wick configuration.

In some embodiments of the invention, the helical wick (114) comprises cotton, wood, or other burnable material. This burnable material may comprise the entire wick, or alternatively, as shown in FIG. 3, may comprise a central core of the wick.

Figure 3A:
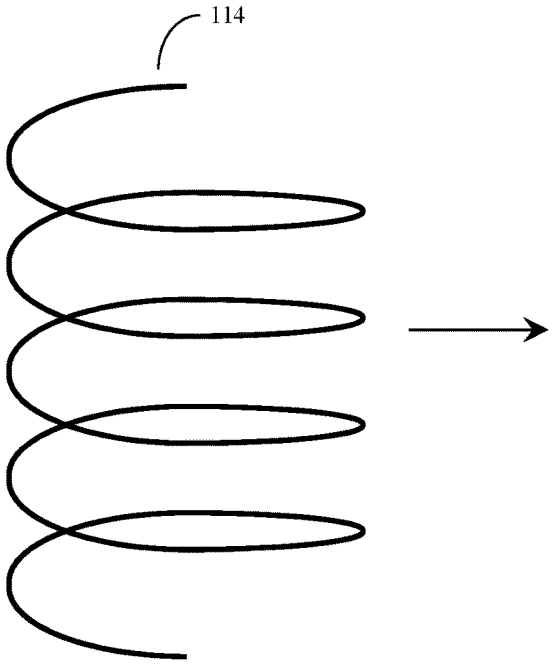
FIG. 3A shows an embodiment of the larger radius (about 1" radius) helical wick where the wick central core material is not covered with an outer sheath.
Figure 3B:
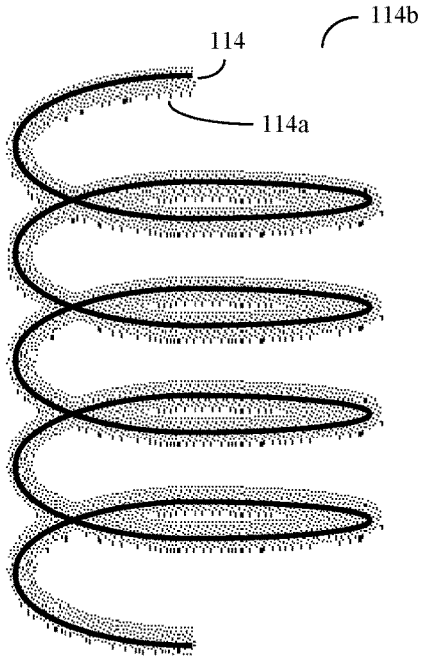
FIG. 3B shows an embodiment of the larger radius helical wick where the wick central core material is covered by an outer sheath, thus increasing the thickness of the helical wick to at least 1/16" or greater.

FIGS. 3A and 3B shows some alternate embodiments of the helical wick portion of the invention. In FIG. 3A, the wick (114) is composed only of a central core" of cotton, wood, or other burnable material. By contrast, in FIG. 3B, the wick (114*b*) is composed of the central core of cotton, wood, or other burnable material, but also further comprises an outer sheath (114*a*) of organic cellulose or cellulosic fibers wound around the helical wick's central core (114).

This outer sheath may be useful for various purposes, such as to convey additional rigidity or burn resistance to the wick so that the tip of the wick keeps a more upright shape during burning, resulting in a better candle flame. The outer sheath can also help modulate the speed at which the central core burns.

Although in some embodiments, the outer sheath may be comparatively dry (e.g. water content under 20% by weight), other some embodiments, the outer sheath (114*a*) may comprise hydrated (e.g. water containing) organic cellulose or cellulosic fibers with a moisture content of at least 50% by weight. In these embodiments, the outer sheath (114*a*) may comprise plant leaves (onion shoots have been found to work well) or other hydrated plant fibers.

Figure 5B:
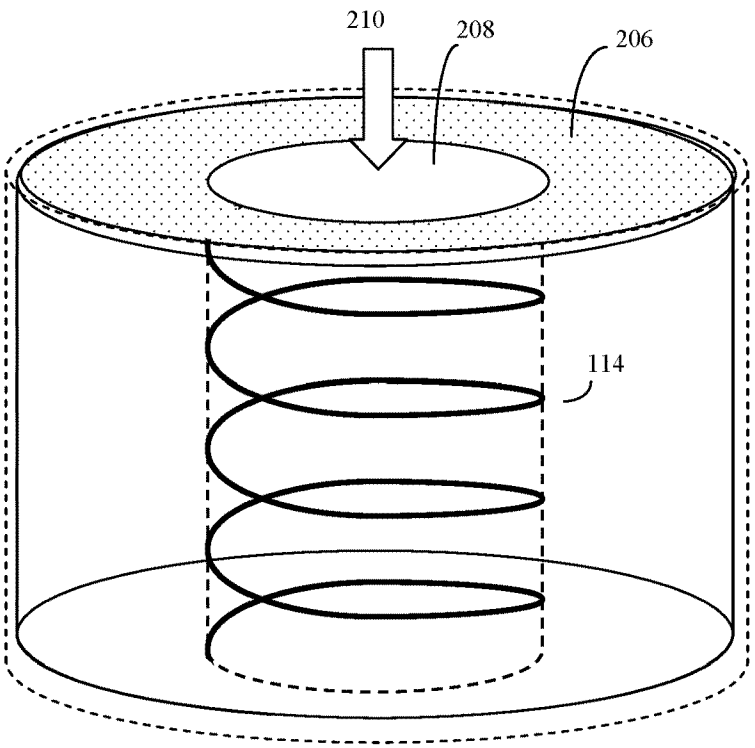
FIG. 5B shows a later step in a method of producing the helical wick candle apparatus. Here, after the meltable material has solidified, the rod is withdrawn, leaving the helical wick embedded in the sides of the resulting cylindrical cavity. This cylindrical cavity is then filled with additional melted meltable material. When this solidifies, the candle is formed.
Figure 5A:
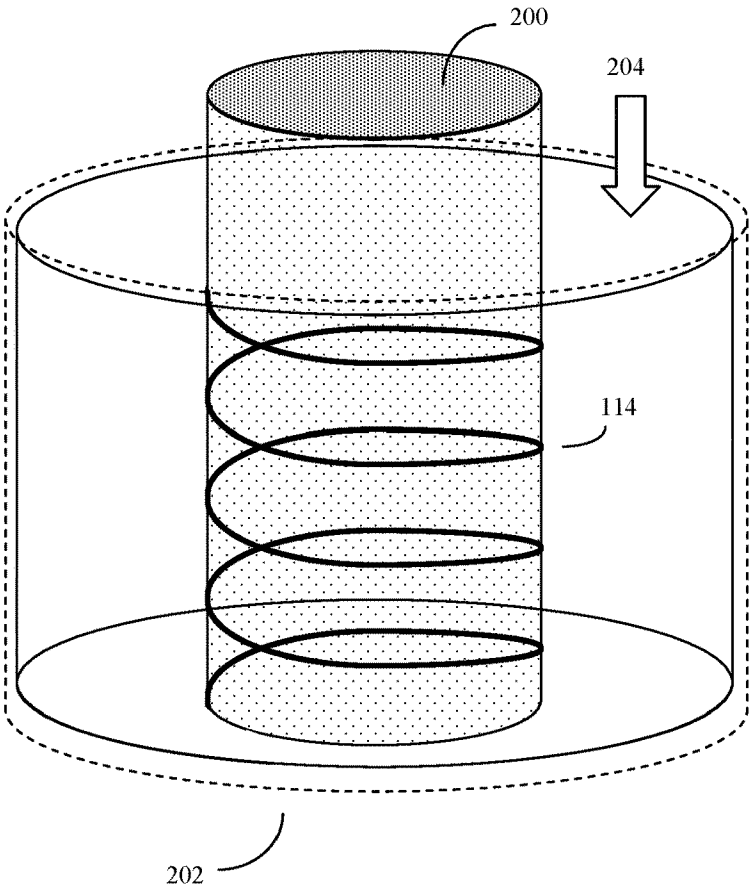
FIG. 5A shows an earlier step in a method of producing the helical wick candle apparatus, in which the wick is wound around a rod in a helical manner, placed into a candle mold, which is then filled with melted meltable material.

Although FIGS. 1A-2B show a free standing candle without a support (e.g. a substantially free standing candle that is not surrounded on the candle circumference 108), in other embodiments support (e.g. candle within a glass, metal, or other type of container) can also be provided. For example, in some embodiments, the candle apparatus can be surrounded (e.g. cover) at least the candle circumference (108) and the candle bottom (112) by a burn resistant support configured to retain the meltable fuel while the meltable fuel is in a melted state. An example of such a container (where in this case the container also can operate as a candle mold) is shown in FIG. 5A (202).

Alternatively, in some embodiments, either with or without a support, the helical wick (114) can be configured so that the candle apparatus will retain a substantial portion of an outer shell of unmelted meltable fuel (e.g. FIG. 1B 134, FIG. 2B 134*a*). This outer shell may be relatively thick (e.g. greater than ¼" thick), or may be relatively thin to efficiently burn fuel. In the thin fuel efficient configuration, this outer shell (134, 134*a*) may be between ⅛" and ¼" thick, so that it remains self-supporting while the candle's helical wick (114) burns. The candle may be configured so that this outer shell persists even when the wick (114) burns from candle top (110) candle bottom (112)

In a preferred embodiment, the helical wick (114) may be configured so that the candle apparatus will consume substantially all of said meltable fuel while burning the helical wick from the candle top (110) to candle bottom (112). Other embodiments will work, however, and in some embodiments, it may be useful to terminate the end of the wick (124) slightly above the bottom of the candle (112). Alternatively some portion of the wick (124) may continue slightly beyond the bottom of the candle (112).

Figure 4:
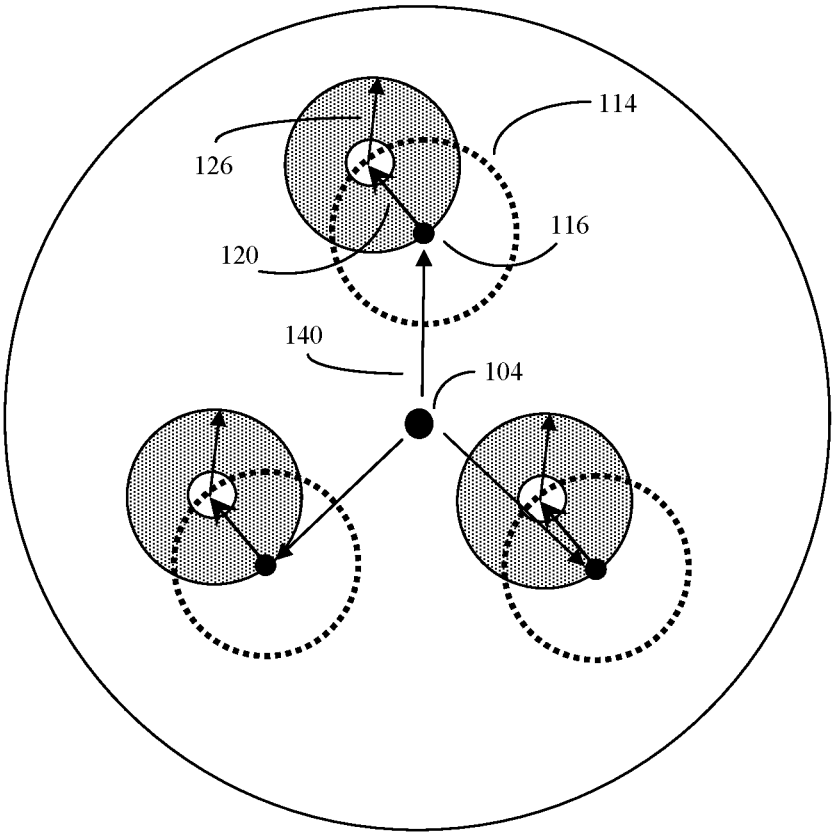
FIG. 4 shows a top view of an embodiment of the candle apparatus employing a plurality of smaller diameter helical wicks.

Although the FIGS. 1A-2C show candles configured with only one helical wick, other multiple wick configurations are also contemplated. This is shown, in top view, in FIG. 4.

In some embodiments, the invention may comprise a plurality of helical wicks (e.g. a plurality of 114), each with a helical wick axis (116) offset a fixed distance (140) (e.g. a helical wick axis displacement distance) from the candle axis (104). Here, each of these helical wicks may have a burnable tip (118) and a helical wick radius (120) that, when combined with this fixed distance (140) is still less than the candle radius (106).

In an alternative embodiment, the invention may also comprise a method of constructing a candle apparatus with a candle height, candle axis, candle radius, and candle circumference, candle top and candle bottom. This method is illustrated in FIGS. 5A and 5B.

This method operates by winding a wick (114) (which may initially start off in a substantially linear form or other shape), around an often smooth and substantially cylindrical, oval, or regular solid (e.g. n-sided regular solid, where n is 3 or higher) rod (200) (here called a "cylindrical" rod, or "wick rod") to form a helical wick with a helical wick (114) with an axis disposed proximate (or displaced from) the candle axis. As previously discussed, this helical wick will have a burnable tip, a helical wick radius that is less than the candle radius, a helical wick pitch, and a helical wick height that is at least as great as the candle height.

The wick rod will typically have a radius of at least 3/16", often ¼", ½" or greater. The helical wick itself will often have a radius of at least 1/16", and thus the helical wick formed by winding the wick around this rod will also have a resulting helical wick radius of at least ¼" (e.g. 3/16 rod radius+radius of wick itself), ½" or greater. This wick rod (200) and helical wick (114) will then be placed inside a candle mold (which in some embodiments can also be a candle support), often proximate the center of the candle mold. The center of the candle mold typically is the same as the resulting candle axis (104).

Alternatively (for multi-wick embodiments) multiple rods and wicks may be placed inside of the candle mold, often displaced a fixed distance (140) displaced from the center of the candle mold.

In a preferred version of this method, the wick rod and helical wick will be placed in the mold so as to extend from at least the candle top to the candle bottom, such that the wick will make at least one full turn between the candle top and the candle bottom. The helical wick will also be configured so that when the tip burns in a body of meltable fuel, the meltable fuel melts within a melting radius of the tip. The overall geometry of the rod, wick and mold will be such that a sum of the helical wick radius and this melting radius is less than the candle circumference (e.g. circumference of the candle mold).

As shown in FIG. 5A, once this configuration has been achieved, the candle mold will be filled with melted meltable fuel (204).

After this meltable fuel has hardened, this wick rod (200) will then be removed so that the helical wick (114) remains affixed to the hardened meltable fuel, as is shown in FIG. 5B. This process will result in a cylindrical void (208) in the meltable fuel, and the helical wick (114) will remain stuck to the sides of this cylindrical void.

To complete the process, this void (208) will then be filled with additional melted meltable fuel. Once this is hardened (and the candle optionally removed from the mold 202), then the candle is complete.

Example

A 3⅝" diameter cylindrical candle that is 3" high was created in a transparent container. The helical wick was formed by first covering a cotton wick in a hydrated onion shoot outer sheath, and then wrapping this wick around a ½" diameter rod with a pitch of 2.1372 inches (e.g. about 1.4 turns around the rod up to a height of 3 inches. Melted wax was poured into the candle and allowed to harden. The rod was then removed, leaving the helical wick embedded into the candle wax. The remaining cylindrical hole was filled with melted wax, which was then allowed to harden.

When tested, the resulting candle performed with higher efficiency than a normal straight wick candle of the exact same size and shape, and nearly all of the wax, with the exception of about a ⅛" shell of wax along the circumference of the candle, was consumed.

The invention claimed is:

1. A candle apparatus with a candle height, candle axis, candle radius, and candle circumference, candle top and candle bottom, comprising:

a body of meltable fuel filling said candle and any voids in said candle;

a helical wick with a helical wick axis disposed proximate said candle axis, said helical wick having a burnable tip, a helical wick radius from said helical wick axis that is less than said candle radius, a helical wick pitch, and a helical wick height that is at least as great as said candle height;

wherein said helical wick radius is at least ¼";

said helical wick extending from at least said candle top to said candle bottom, and making at least one full turn between said candle top to said candle bottom;

said helical wick configured so that when said tip burns in said body of meltable fuel, said meltable fuel melts within a melting radius of said tip in a rotating manner, thus consuming at least 1.5× more meltable fuel than a corresponding straight wick;

wherein a sum of said helical wick radius and said melting radius is less than said candle radius, thus maintaining, after said candle is burned, at least some remaining wall of unmelted meltable fuel around said candle circumference.

2. The candle apparatus of claim 1, wherein said helical wick comprises cotton, wood, or other non-meltable burnable material.

3. The candle apparatus of claim 2, wherein said helical wick further comprises an outer sheath, said outer sheath comprising organic cellulose or cellulosic fibers wound around said helical wick.

4. The candle apparatus of claim 3, wherein said outer sheath comprises hydrated organic cellulose or cellulosic fibers with a moisture content of at least 50% by weight.

5. The candle apparatus of claim 4, wherein said outer sheath comprises plant leaves or other hydrated plant fibers.

6. The candle apparatus of claim 1, wherein said candle apparatus is surrounded on both said candle circumference and said candle bottom by a glass or metal container configured to retain said meltable fuel while said meltable fuel is in a melted state.

7. The candle apparatus of claim 6, wherein said helical wick is configured so that said candle apparatus will consume substantially all of said meltable fuel while burning said helical wick from said candle top to said candle bottom.

8. The candle apparatus of claim 1, wherein said candle apparatus is a substantially free standing candle that is not surrounded on said candle circumference.

9. The candle apparatus of claim 8, wherein said helical wick is configured so that said candle apparatus will retain a substantial portion of an outer shell of unmelted meltable fuel that is between ⅛" and ¼" thick while burning said helical wick from said candle top to said candle bottom.

10. The candle apparatus of claim 1, wherein said helical wick pitch is configured so that said tip, when said tip burns in said body of meltable fuel, rotates through one complete turn of said helical wick during substantially a same amount of time that it takes for said helical wick to burn said meltable fuel melted by said tip.

11. A candle apparatus with a candle height, candle axis, candle radius, and candle circumference, candle top and candle bottom, comprising:

a body of meltable fuel filling said candle and any voids in said candle;

a plurality of helical wicks, each with a helical wick axis offset a fixed distance from said candle axis, each said helical wick having a burnable tip, a helical wick radius from said helical wick axis that, when combined with said fixed distance is less than said candle radius, a helical wick pitch, and a helical wick height that is at least as great as said candle height;

wherein each said helical wick radius is at least ¼";

each said helical wick extending from at least said candle top to said candle bottom, and making at least one full turn between said candle top to said candle bottom;

each said helical wick configured so that when said tip burns in said body of meltable fuel, said meltable fuel melts within a melting radius of each said tip, said meltable fuel melts within a melting radius of said tip in a rotating manner, thus consuming at least 1.5× more meltable fuel than a corresponding straight wick;

wherein a sum of said fixed distance, said helical wick radius and said melting radius is less than said candle radius, thus maintaining, after said candle is burned, at least some remaining wall of unmelted meltable fuel around said candle circumference.

12. A method of constructing a candle apparatus with a candle height, candle axis, candle radius, and candle circumference, candle top and candle bottom, said method comprising:

winding a wick around a smooth and substantially cylindrical, oval, or n-sided regular solid wick rod, where n is equal to or greater than 3, said wick placed to form a helical wick with a helical wick axis disposed proximate said candle axis, said helical wick having a burnable tip, a helical wick radius from said helical wick axis that is less than said candle radius, a helical wick pitch, and a helical wick height that is at least as great as said candle height;

wherein said wick rod has at least a 3/16" radius, and said helical wick has a helical wick radius of at least 1/4";

placing said wick rod and helical wick proximate a center of a candle mold;

said wick rod and helical wick extending from at least said candle top to said candle bottom, and making at least one full turn between said candle top to said candle bottom;

said helical wick configured so that when said tip burns in a body of meltable fuel, said meltable fuel melts within a melting radius of said tip in a rotating manner, thus consuming at least 1.5× more meltable fuel than a corresponding straight wick;

wherein a sum of said helical wick radius and said melting radius is less than said candle radius;

filling said candle mold with melted meltable fuel;

after said meltable fuel has hardened, removing said wick rod so that said helical wick remains affixed to hardened said meltable fuel;

and filling a void left by said wick rod with additional melted meltable fuel.

13. The method of claim 12, wherein said helical wick comprises cotton, wood, or other burnable material.

14. The method of claim 13, wherein said helical wick further comprises an outer sheath of organic cellulose or cellulosic fibers wound around said helical wick.

15. The method of claim 14, wherein said outer sheath comprises hydrated organic cellulose or cellulosic fibers with a moisture content of at least 50% by weight; or wherein said outer sheath comprises plant leaves or other hydrated plant fibers.

16. The method of claim 12, wherein said candle apparatus is surrounded on said candle circumference and said candle bottom by a burn resistant support configured to retain said meltable fuel while said meltable fuel is in a melted state.

17. The method of claim 16, wherein said helical wick is configured so that said candle apparatus will consume substantially all of said meltable fuel while burning said helical wick from said candle top to said candle bottom.

18. The method of claim 12, wherein said candle apparatus is a substantially free standing candle that is not surrounded on said candle circumference.

19. The method of claim 18, wherein said helical wick is configured so that said candle apparatus will retain a substantial portion of an outer shell of unmelted meltable fuel that is between 1/8" and 1/4" thick while burning said helical wick from said candle top to said candle bottom.

20. The method of claim 12, wherein said helical wick pitch is configured so that said tip, when said tip burns in said body of meltable fuel, rotates through one complete turn of said helical wick during substantially a same amount of time that it takes for said helical wick to burn said meltable fuel melted by said tip.

21. The candle apparatus of claim 1, wherein said wick further comprises a wire stiffener.

* * * * *